US008378202B2

(12) United States Patent
Ahn et al.

(10) Patent No.: US 8,378,202 B2
(45) Date of Patent: Feb. 19, 2013

(54) PORTABLE COMMUNICATION DEVICE CAPABLE OF VIRTUALLY PLAYING MUSICAL INSTRUMENTS

(75) Inventors: Chi-Young Ahn, Seoul (KR); Sang-Min Hyun, Seoul (KR); Chang-Hwan Hwang, Goyang-si (KR)

(73) Assignee: Samsung Electronics Co., Ltd (KR)

( * ) Notice: Subject to any disclaimer, the term of this patent is extended or adjusted under 35 U.S.C. 154(b) by 110 days.

(21) Appl. No.: 12/544,659

(22) Filed: Aug. 20, 2009

(65) Prior Publication Data

US 2010/0043627 A1 Feb. 25, 2010

(30) Foreign Application Priority Data

Aug. 21, 2008 (KR) ..... 10-2008-0082021

(51) Int. Cl.
*G10H 1/38* (2006.01)

(52) U.S. Cl. ..... 84/723; 84/637; 84/735

(58) Field of Classification Search ..... 84/723
See application file for complete search history.

(56) References Cited

U.S. PATENT DOCUMENTS

| | | | | |
|---|---|---|---|---|
| 6,005,181 | A * | 12/1999 | Adams et al. | 84/734 |
| 6,191,350 | B1 * | 2/2001 | Okulov et al. | 84/646 |
| 6,501,012 | B1 * | 12/2002 | Toba et al. | 84/724 |
| 6,504,090 | B2 * | 1/2003 | Tsai et al. | 84/615 |
| 6,541,688 | B2 * | 4/2003 | Asahi | 84/477 R |
| 2003/0084777 | A1 * | 5/2003 | Gaudet | 84/470 R |
| 2006/0060068 | A1 | 3/2006 | Hwang et al. | |
| 2007/0261540 | A1 * | 11/2007 | Gremo et al. | 84/743 |
| 2008/0028920 | A1 * | 2/2008 | Sullivan | 84/722 |
| 2008/0034949 | A1 * | 2/2008 | Nishitani et al. | 84/735 |
| 2008/0250914 | A1 * | 10/2008 | Reinhart et al. | 84/645 |
| 2008/0307945 | A1 * | 12/2008 | Gatzsche et al. | 84/477 R |

FOREIGN PATENT DOCUMENTS

| | | |
|---|---|---|
| KR | 1020060019276 | 3/2006 |
| KR | 1020060038141 | 5/2006 |
| KR | 100687693 | 2/2007 |
| KR | 1020070019090 | 2/2007 |

* cited by examiner

*Primary Examiner* — Christopher Uhlir
(74) *Attorney, Agent, or Firm* — The Farrell Law Firm, P.C.

(57) ABSTRACT

An instrument-playing portable communication device is provided. The device includes an instrument-playing key unit having one or more keys, provided on a body of the instrument-playing portable communication device. When a user selects a chord of a selected instrument by pressing at least one of the one or more keys, the instrument-playing key unit converts the at least one key press into a first signal. The device also includes a sensor unit mounted in the body, for sensing a motion of a user. When the user presses the at least one of the one or more keys and moves in a location near the sensor unit, the sensor unit senses a motion of the user and converts the motion into a second signal. The device further includes a controller for receiving the first signal from the instrument-playing key unit and the second signal from the sensor unit, generating a tone frequency of the selected instrument based on the received signals, and converting the tone frequency into a tone. The device additionally includes an amplifier for amplifying the tone output from the controller, and outputting the amplified tone through a speaker mounted in the body.

7 Claims, 4 Drawing Sheets

PORTABLE COMMUNICATION DEVICE CAPABLE OF VIRTUALLY PLAYING MUSICAL INSTRUMENTS

PRIORITY

This application claims priority under 35 U.S.C. §119(a) to a Korean Patent Application filed in the Korean Intellectual Property Office on Aug. 21, 2008 and assigned Serial No. 10-2008-82021, the entire disclosure of which is incorporated herein by reference.

BACKGROUND OF THE INVENTION

1. Field of the Invention

The present invention relates generally to a portable communication device, and more particularly, to an instrument-playing portable communication device that includes an instrument-playing key unit and a sensor unit for sensing motions of a user.

2. Description of the Related Art

A "portable communication device" generally refers to an electronic device with which a user can wirelessly communicate with another party, while it is carried with him or her. Portable communication devices have been designed considering factors such as miniaturization, slimness, easy-to-grip, and lightweight due to their portability. Portable communication devices have also been incorporated with multimedia capable of supporting an increasing number of functions.

In compliance with the above-mentioned tendencies, the portable communication devices may serve as an MP3 player, or the like, to allow a user to listen to music. They are also capable of supporting an instrument playing service, which extends from a function of editing melodies and bells that can be used for various purposes.

However, the conventional portable communication device, with which a user can listen to music, has no function in which the user can play instruments in the manner the actual instrument is played.

For example, Korean Patent Application no. 10-2002-66875, entitled "Portable Phone with Melody Playing Function," discloses a portable phone with a built-in melody chip, with which a user can play melodies by operating a keypad having a plurality of keys.

An instrument playing service is conventionally provided through the keypad of the portable communication device, which differs significantly in shape from actual instruments.

Further, when playing instruments through the keypad of the portable communication device, a user who is skilled to handle instruments may not be able to competently play the instruments with the keypad of the portable communication device.

In addition, because of the limited number of keys provided on the keypad of the portable communication device, it is difficult to provide an instrument playing service over a variety of registers of instruments.

Additionally, the time required to push down keys can not be reduced, making it difficult to skillfully play instruments such as a guitar and a cello, with the keypad of the portable communication device.

SUMMARY OF THE INVENTION

The present invention has been made to address at least the above problems and/or disadvantages and to provide at least the advantages described below. Accordingly, an aspect of the present invention provides an instrument-playing portable communication device with an instrument-playing key unit and a sensor unit for sensing motions of a user, which allows the user to generate tones of instruments by playing a variety of instruments in person through the portable communication device without the need for real instruments.

Another aspect of the present invention provides an instrument-playing portable communication device with an instrument-playing key unit and a sensor unit for sensing motions of a user, which allows the user to listen to tones of instruments by playing a variety of instruments in person through the portable communication device.

Another aspect of the present invention provides an instrument-playing portable communication device with at least one touch key input unit capable of mixing two or more tones, which allows a user to listen to tones in various forms.

According to one aspect of the present invention, an instrument-playing portable communication device is provided. The device includes an instrument-playing key unit having one or more keys, provided on a body of the instrument-playing portable communication device. When a user selects a chord of a desired instrument by pressing at least one of the one or more keys, the instrument-playing key unit converts the at least one key press into a first signal. The device also includes a sensor unit mounted in the body, for sensing a motion of a user. When the user presses the at least one of the one or more keys and moves in a location near the sensor unit, the sensor unit senses a motion of the user and converts the motion into a second signal. The device further includes a controller for receiving the first signal from the instrument-playing key unit and the second signal from the sensor unit, generating a tone frequency of the selected instrument based on the received signals, and converting the tone frequency into a tone. The device additionally includes an amplifier for amplifying the tone output from the controller, and outputting the amplified tone through a speaker mounted in the body.

BRIEF DESCRIPTION OF THE DRAWINGS

The above and other aspects, features and advantages of the present invention will be more apparent from the following description taken in conjunction with the accompanying drawings, in which.

DETAILED DESCRIPTION OF PREFERRED EMBODIMENTS

Figure 1:
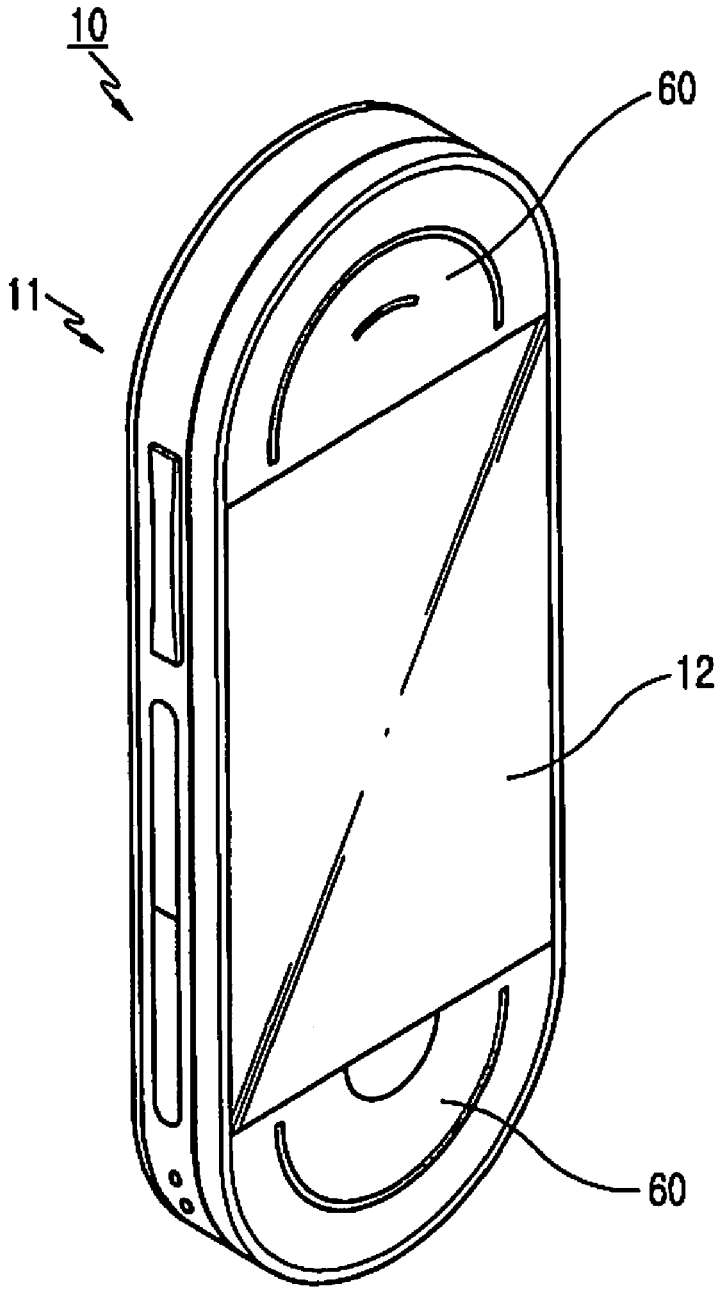
FIG. 1 is a perspective view of an instrument-playing portable communication device according to an embodiment of the present invention.
Figure 2:
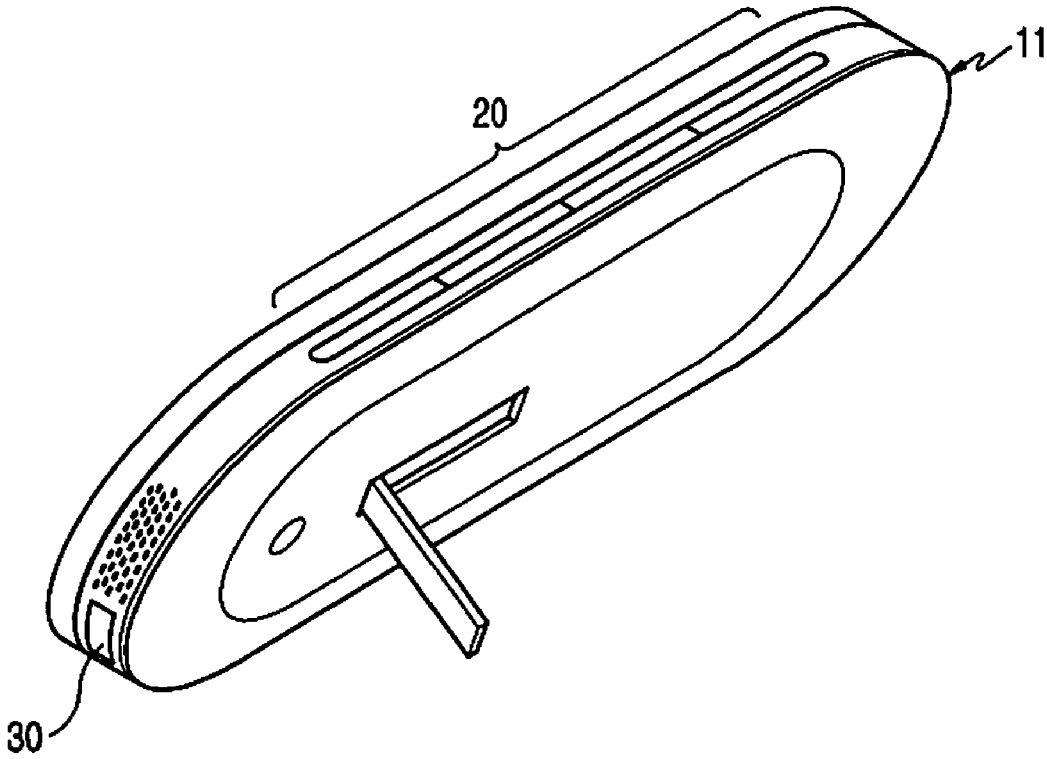
FIG. 2 is a perspective view of an instrument-playing key unit and a sensor unit mounted on an instrument-playing portable communication device according to an embodiment of the present invention.

Preferred embodiments of the present invention are described in detail with reference to the accompanying drawings. The same or similar components may be designated by the same or similar reference numerals although they are illustrated in different drawings. Detailed descriptions of constructions of processes known in the art may be omitted to avoid obscuring the subject matter of the present invention.

The terms and words used in the following description and claims are not limited to their dictionary meanings, but, are merely used by the inventor to enable a clear and consistent understanding of the invention. Accordingly, it should be apparent to those skilled in the art that the following description of preferred embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

As illustrated in FIGS. 1 to 4, a portable communication device 10 includes a display 12, a keypad 13, a memory 14, an audio signal processor 90, a microphone 15, and a speaker 16.

Specifically, the instrument-playing portable communication device 10 includes an instrument-playing key unit 20 with at least one key, a sensor unit 30, a touch key input unit 60, a controller 40, a tone chip 70, a tone filter 80, and an amplifier 50. The instrument-playing key unit 20 is provided on a side of a body 11 of the portable communication device 10 so that a user can select a chord of an instrument that he or she intends to play, and can push down keys according to the selected chord of the instrument. The sensor unit 30 is mounted in the body 11 to sense motions of the user. When the user selects a mode of an instrument that he or she desires to play, by pressing one of the keys on the instrument-playing key unit 20, and presses keys on the instrument-playing key unit 20 according to a chord of the instrument, the instrument-playing key unit 20 converts the key presses into signals. When the user moves in a location near the sensor unit 30 while pressing keys on the instrument-playing key unit 20, the sensor unit 30 senses motions of the user and converts the motions into signals. The controller 40, built in the body 11, receives the signals from the instrument-playing key unit 20 and the signals from the sensor unit 30, generates tone frequencies of the selected instrument based on the received signals, and converts the tone frequencies into tones. The amplifier 50, also built in the body 11, amplifies the tones output from the controller 40 and outputs the amplified tones through the speaker 16 mounted in the body 11.

Figure 4:
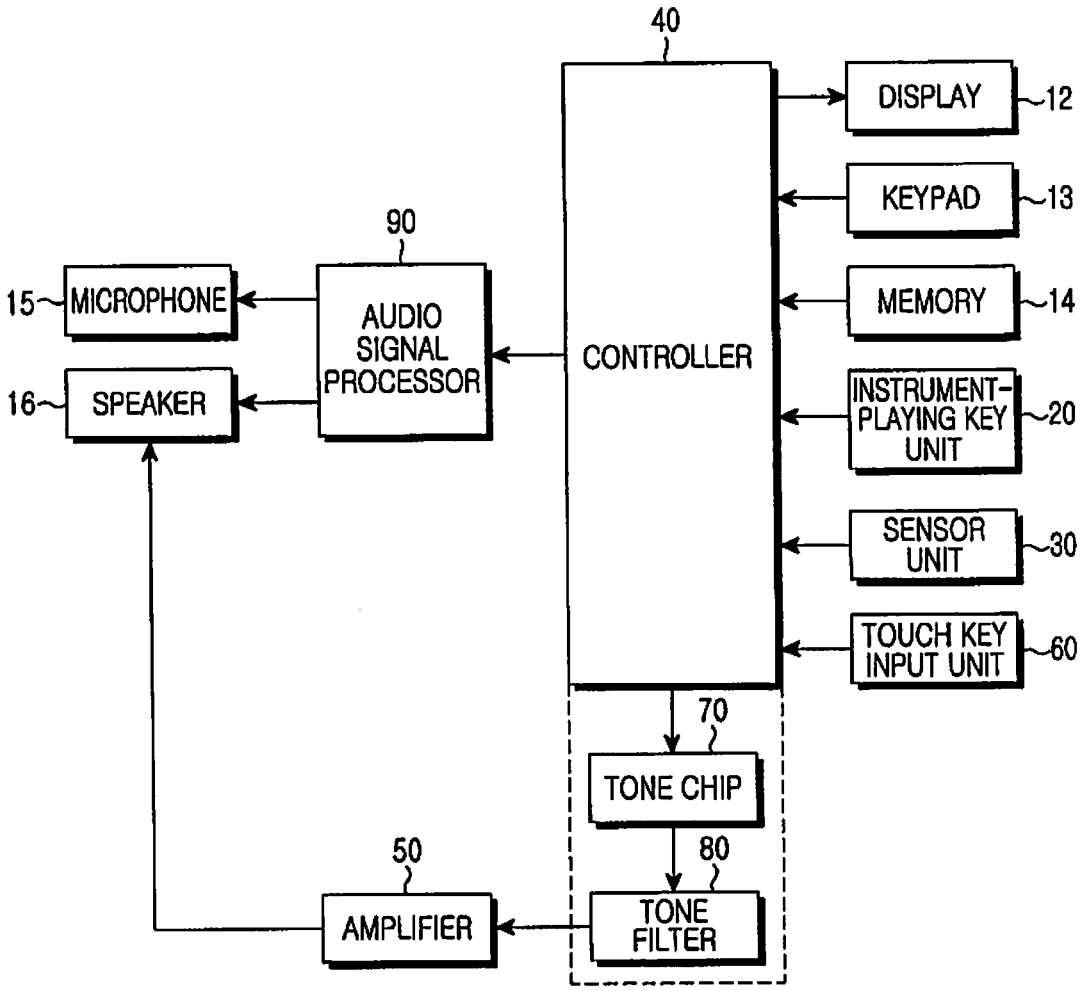
FIG. 4 is a block diagram illustrating a structure of an instrument-playing portable communication device according to an embodiment of the present invention.

As illustrated in FIG. 4, the tone chip 70 is adapted to generate tone frequencies of the selected instrument based on the signals from the instrument-playing key unit 20 and the signals from the sensor unit 30. The tone filter 80 is adapted to output tones by filtering the tone frequencies.

The touch key input unit 60 is mounted on an outer side of the body 11 to mix two or more tones.

The sensor unit 30 may include a motion sensor to sense motions of the user.

The selected chord of the instrument is displayed on the display 12, and additional playing information, including words of songs, musical scores, etc. can also be displayed on the display 12.

With reference to FIGS. 1 to 4, a detailed description is provided for an operation of the instrument-playing portable communication device according to an embodiment of the present invention.

To play instruments with the portable communication device 10, the user first selects an instrument that he or she desires to play.

Figure 3:
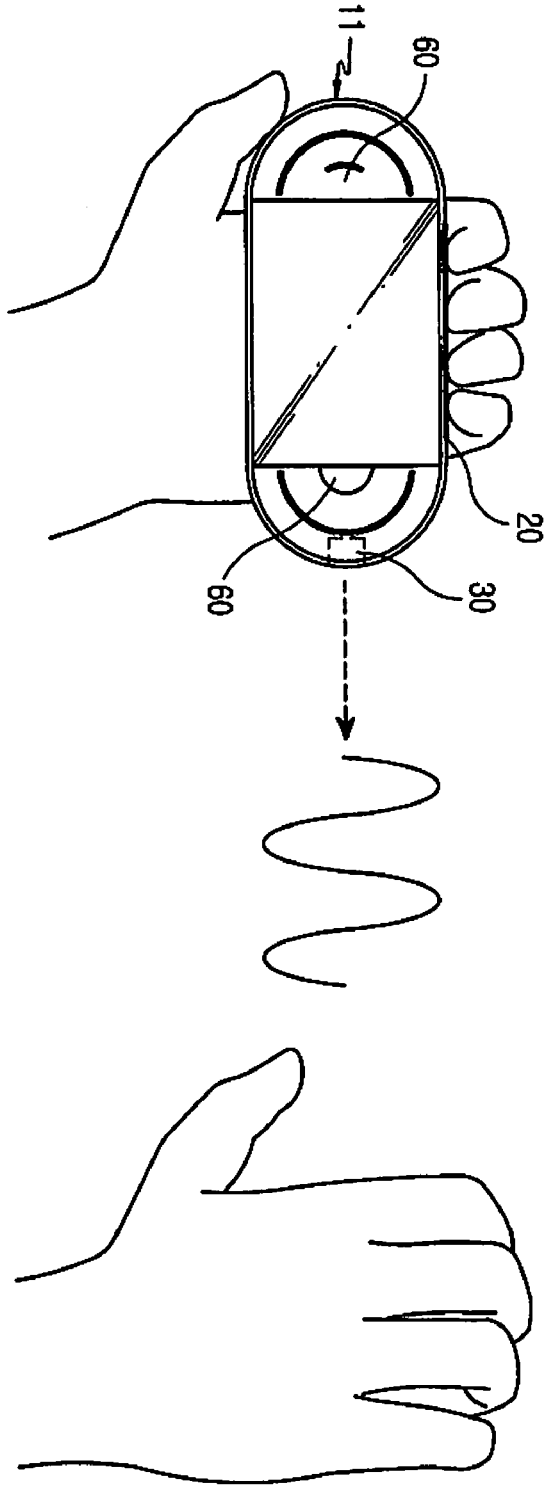
FIG. 3 is a diagram illustrating operation of an instrument-playing portable communication device according to an embodiment of the present invention.

As illustrated in FIG. 3, when a user plays, for example, a guitar, the user selects and presses a guitar-playing key on the instrument-playing key unit 20 mounted on a side of the body 11 of the portable communication device 10.

When the user presses the guitar-playing key, the instrument-playing key unit 20 converts the key press into a signal, and applies the signal to the controller 40. The controller 40 sets keys on the instrument-playing key unit 20 so that playing a guitar is possible.

In this state, the user grips the body 11 with the left hand and puts the left-hand fingers on the keys of the instrument-playing key unit 20 according to a guitar chord. At the same time, the user puts the right hand in the location near the sensor unit 30 mounted on the bottom of the body 11, and takes the motion of plucking the strings as if he or she plays the real guitar.

If the user puts the left-hand fingers on the keys of the instrument-playing key unit 20 and presses one of the keys, the portable communication device 10 enters a guitar mode where a sound of a guitar chord corresponding to the pressed key can be generated. In this state, if the user moves the right hand up and down in the location near the sensor unit 30, the sensor unit 30 senses motions of the right hand and generates a sound signal corresponding thereto.

As illustrated in FIG. 4, if the user presses the keys on the instrument-playing key unit 20 with the left-hand fingers, the instrument-playing key unit 20 converts the key presses into signals, and applies the signals to the controller 40. At the same time, the sensor unit 30 senses the motions of the user's right hand, converts the motions into signals, and applies the signals to the controller 40.

The controller 40 receives the signals from the instrument-playing key unit 20 and the signals from the sensor unit 30, and generates tone frequencies of the guitar using the tone chip 70, and the tone filter 80 outputs tones by filtering the tone frequencies.

The amplifier 50 amplifies the output tones, and outputs the played guitar music as sound through the speaker 16 mounted in the body 11.

In this manner, instead of simply listening to the music through the portable communication device 10, the user can skillfully play the guitar by gripping the body 11 with one hand and shaking another hand as though he or she actually plays a guitar, and the user can listen to the music being played.

The guitar chord can be set by the user at his/her discretion according to the music being played.

In addition to the guitar, a cello and various other instruments can also be played with the portable communication device 10.

Further, two or more tones can be mixed by pressing the touch key input unit 60.

While the invention has been shown and described with reference to certain preferred embodiments thereof, it will be understood by those skilled in the art that various changes in form and detail may be made therein without departing from the spirit and scope of the invention as defined by the appended claims and their equivalents.

What is claimed is:

1. An instrument-playing portable communication device comprising:

an instrument-playing key unit having one or more keys provided on a body of the instrument-playing portable communication device;

a sensor unit mounted in the body of the instrument-playing portable communication device;

a controller for receiving a first signal from the instrument-playing key unit and a second signal from the sensor unit, for generating a tone frequency based on the received first and second signals, and for converting the tone frequency into a tone; and an amplifier for amplifying the tone output from the controller, and outputting the amplified tone through a speaker mounted in the body, wherein a instrument-playing portable communication device converts a chord selected by pressing of at least one key by a finger of a user's first hand into the first signal, and wherein a motion sensor of the sensor unit senses a motion of the user's second hand relative to a location of the sensor unit being held in the user's first hand to sense a relative motion between the user's two hands.

2. The instrument-playing portable communication device of claim 1, further comprising at least one touch key input unit mounted on the body to mix two or more tones.

3. The instrument-playing portable communication device of claim 1, wherein the instrument-playing key unit is mounted on a side of the body.

4. The instrument-playing portable communication device of claim 1, wherein the controller comprises:

a tone chip for generating a tone frequency based on the first signal from the instrument-playing key unit and the second signal from the sensor unit; and a tone filter for outputting the tone by filtering the tone frequency.

5. The instrument-playing portable communication device of claim 1, wherein the instrument-playing key unit applies the first and second signals to the controller at the same time.

6. The instrument-playing portable communication device of claim 1, wherein the selected chord of an instrument selected by the user is displayed on a display mounted in the body.

7. The instrument-playing portable communication device of claim 5, wherein additional playing information including words of a song being played is displayed on a display.

* * * * *